US005624367A

United States Patent [19]

Budziszewski

[11] Patent Number: 5,624,367

[45] Date of Patent: Apr. 29, 1997

[54] BOTTOM BLANK MAKER WORKSTATION FOR A CUP MAKING MACHINE

[75] Inventor: Mark J. Budziszewski, Wind Lake, Wis.

[73] Assignee: Paper Machinery Corporation, Milwaukee, Wis.

[21] Appl. No.: 306,461

[22] Filed: Sep. 15, 1994

[51] Int. Cl.[6] ..... B65H 45/12

[52] U.S. Cl. ..... 493/167; 493/109; 493/58; 493/79; 493/356; 72/348

[58] Field of Search ..... 493/58, 76, 79, 493/105–109, 167, 356, 156, 158, 159; 72/348; 413/4, 6, 31, 35

[56] References Cited

U.S. PATENT DOCUMENTS

| | | | |
|---|---|---|---|
| 1,915,164 | 6/1933 | Orem | 72/348 |
| 2,017,054 | 10/1935 | Bruun | 72/348 |
| 2,076,906 | 4/1937 | MacCordy | 493/58 |
| 2,216,331 | 10/1940 | Swallow | 493/106 |
| 3,695,201 | 10/1972 | Frankenberg | 72/348 |
| 3,745,891 | 7/1973 | Bodendoerfer . | |
| 3,990,353 | 11/1976 | Richards | 493/108 |
| 4,349,345 | 9/1982 | Bodendoerfer . | |
| 4,490,130 | 12/1984 | Konzal et al. . | |
| 4,571,233 | 2/1986 | Konzal . | |
| 5,324,249 | 6/1994 | Konzal . | |

*Primary Examiner*—Jack W. Lavinder
*Attorney, Agent, or Firm*—Foley & Lardner

[57] ABSTRACT

A bottom blank maker workstation for a cup making machine is disclosed. The cup making machine is of the type having a rotating turret and a plurality of mandrels arranged to interact with a plurality of workstations. The turret moves each mandrel in a stepwise fashion through the plurality of workstations where a bottom blank and a sidewall blank are formed and attached to one another to create a container. The workstation includes a reciprocable punch and draw that cooperate with an abutment surface and a series of protrusions to impress the lip of the bottom blank with a series of indentations. The indentations promote a better seal to the sidewall blank.

14 Claims, 9 Drawing Sheets

BOTTOM BLANK MAKER WORKSTATION FOR A CUP MAKING MACHINE

FIELD OF THE INVENTION

The present invention relates generally to cup or container making machines and a workstation for use with a turret-type cup making machine, and particularly to a workstation for forming the bottom blank of a cup or container.

BACKGROUND OF THE INVENTION

Cup making machines, such as those manufactured by Paper Machinery Corporation of Milwaukee, Wis., are used to make a variety of cups and containers. A typical cup machine for making paperboard cups, for instance, includes a turret having a plurality of mandrels about which the containers are formed. The turret sequentially rotates the mandrels into cooperation with a variety of workstations where numerous cup forming procedures sequentially occur. In an exemplary procedure, the circular bottom blank is cut at one workstation and attached to the end of a mandrel by a vacuum applied to the mandrel. During this procedure, the outside edge or lip of the bottom blank is folded downwardly. At a subsequent workstation, a sidewall blank is wrapped around the mandrel. The sidewall blank is heated and sealed along a seam which runs generally longitudinally along the side of the cup. (Typically, the paperboard is coated with a thermoplastic material, such as polypropylene, so the blanks may be heated and sealed together.)

The sidewall blank extends transversely to the bottom blank except along the lip which runs approximately parallel with the sidewall blank. In some applications, the sidewall blank includes a flap extending beyond the lip of the bottom blank, and this flap is bent over the lip. At a bottom finishing station, the flap is pressed against the lip from an inside recessed area at the bottom of the cup to seal the sidewall blank and bottom blank together.

There also may be other workstations where various additional cup forming procedures are carried out. For example, one station may be used to create a curl at the top of the cup to provide a more functional drinking container and a better appearance.

At a typical bottom blank maker workstation, a narrow web of bottom blank material, such as paperboard, is fed into the workstation and bottom blanks of desired size and configuration are cut by pressing the web against a cutting edge. Often, the cutting edge is circular in shape to cut disk-like bottom blanks for use in conventional paper cups. After cutting, a "draw" forces the bottom blank through a sleeve or opening sized somewhat smaller than the bottom blank. For example, with disk shaped blanks, the sleeve will be cylindrical in shape and has a diameter smaller than that of the bottom blank. Thus, as the draw forces the bottom blank through the sleeve, an outer edge or lip is folded over to an orientation generally transverse to the remainder of the bottom blank.

The folded bottom blank is forced through the sleeve into engagement with an adjacent mandrel that holds the blank in place via vacuum applied through apertures in its outer end. Subsequently, the turret rotates the bottom blank to another workstation where the sidewall blank is wrapped about the mandrel with a portion or flap extending beyond the lip of the bottom blank. This flap is folded over the lip of the bottom blank to create a recessed area in the bottom of the cup. This bottom area of the cup is heated and a finisher wheel is inserted into the recessed area and moved laterally against the flap to squeeze the flap, bottom blank lip and lower outside region of the sidewall together to form a seal about the bottom of the cup.

A problem that develops in conventional bottom blank maker workstations is the uneven creasing in the lip region which results from its being folded over and slid through the sleeve. Some of the creases resulting from this folding process can be sufficiently large to leave gaps even after the finisher wheel squeezes the lip portion between the flap and lower region of the sidewall blank. This, of course, results in a leaky container or cup.

Another problem that develops with conventional bottom blank maker stations is accumulation of debris, such as paperboard dust and lubricant in the mechanism. Often, the draw will be slidably mounted within a punch unit used to press the bottom blank web against the cutting edge to cut the bottom blank. Because these parts are constantly moving with respect to each other, it is common to use an appropriate lubricant between the components. However, as the bottom blanks are cut and forced through the sleeve, paper dust and lubricant accumulate between the punch and the draw. If enough debris accumulates, it can interfere with the operation of both the draw and the punch. Thus, periodically the machine must be inspected and cleaned of this accumulated debris.

It would be advantageous to provide a bottom blank maker workstation that controlled the creasing of the outer lip while providing for automatic cleaning of accumulated debris.

SUMMARY OF THE INVENTION

The present invention features a bottom blank maker workstation for forming a bottom blank for a cup. The workstation is used with a cup making machine that includes an indexing turret having a plurality of mandrels extending therefrom. Each mandrel is configured to sequentially move into cooperation with the bottom blank maker workstation.

The bottom blank maker workstation comprises a framework and a reciprocable punch slidably mounted to the framework and configured to contact an outer region of the bottom blank to move the bottom blank towards an abutment surface. A plurality of protrusions, such as ribs, are disposed between the reciprocable punch and the abutment surface. Preferably, the protrusions are disposed on and extend from the abutment surface.

A reciprocable draw is slidably mounted to the framework for movement through a sleeve, such as a cylindrical opening. Preferably, the draw is mounted within a hollow interior of the punch.

A reciprocation assembly is connected to both the punch and the draw. The assembly moves the punch towards the abutment surface until the plurality of protrusions impress the bottom blank. Then, it moves the draw past the abutment surface and forces the bottom blank through the sleeve and into cooperation with the adjacent mandrel.

DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
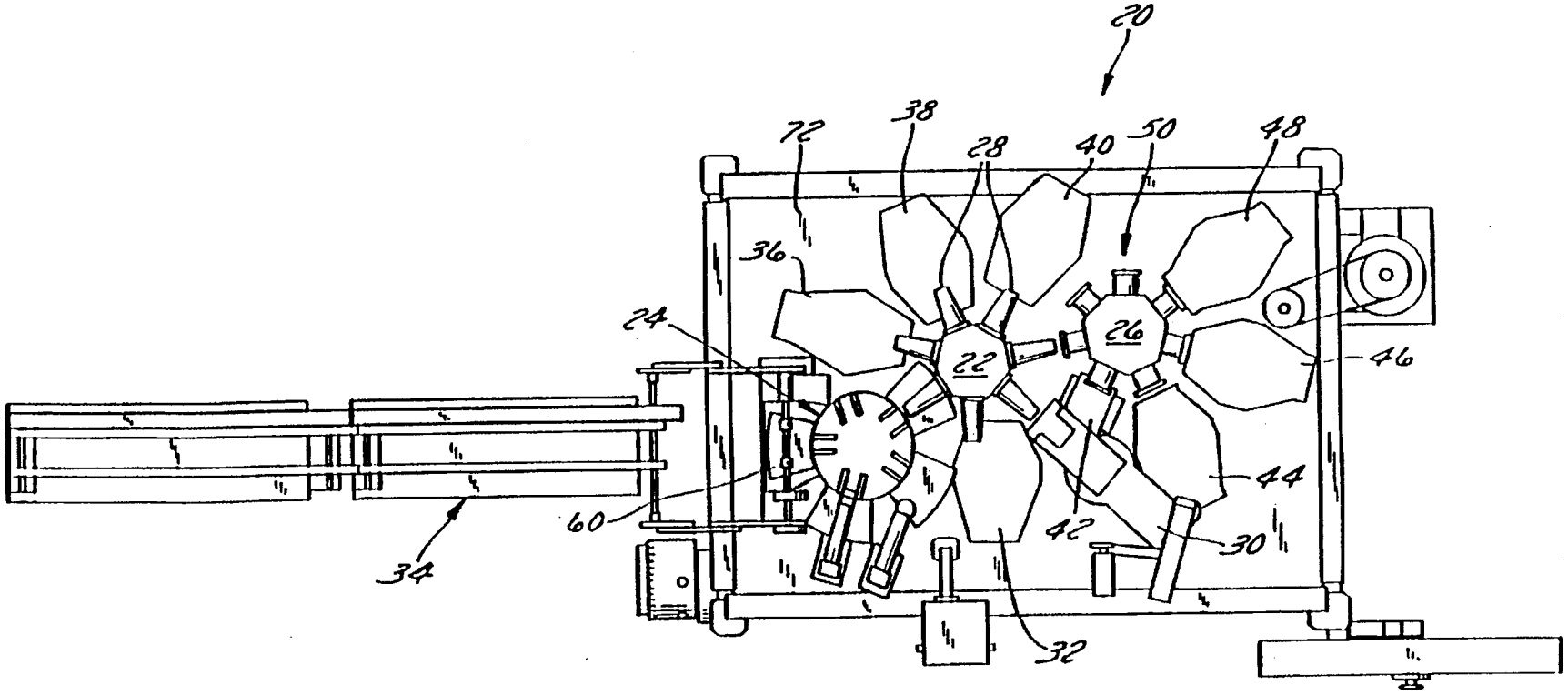
FIG. 1 is a schematic top plan view of a cup making machine having a variety of exemplary workstations disposed about the mandrel turret.

Referring generally to FIG. 1, an exemplary cup making machine 20 is illustrated. This particular design includes a mandrel turret 22 which cooperates with a transfer turret 24 and a rimming turret 26. Mandrel turret 22 includes a plurality of mandrels 28 that are rotated in a stepwise or indexing manner between surrounding workstations. For example, a bottom blank may be applied to a given mandrel 28 at a bottom blank maker workstation 30 and then rotated to a bottom reformer station 32. From this point, the mandrel 28 is rotated into cooperation with the transfer turret 24 which receives sidewall blanks from a hopper 34 and rotates the sidewall blank into cooperation with the cooperating mandrel 28. The sidewall blank is then folded about the mandrel over the bottom blank, heated and sealed along a seam.

Next, the bottom blank and sidewall blank are rotated to a bottom heat station 36. After heating, mandrel turret 22 indexes the subject mandrel 28 to a roller incurl station 38 where a portion of the sidewall blank, i.e. a sidewall blank flap, is bent over an outer lip of the bottom blank to form a recessed bottom in the cup. The cup is then moved to a bottom finish station 40 where the sidewall blank flap and the bottom blank lip are pressed against the lower region of the sidewall blank to form a seal.

Once the bottom is formed and sealed, the cup is transferred to rimming turret 26 and rotated to a lube station 42 and then to a rimming precurl station 44 where the upper lip of the sidewall is curled outwardly. From that station, the cup is indexed to a rimming finish curl station 46 which finishes the curled portion along the top of the cup to make an attractive edge. At this point, the cup may be moved to an optional lid groover station 48 and then to a cup blowoff station 50 for removal of the finished cup.

The above-described cup making machine is one example of many that could incorporate a bottom blank maker workstation 30 according to the present invention, as will be described. Different arrangements of workstations may be used on other cup making machines. For example, some cup making machines use a single turret with additional rimming stations disposed about the single turret. All are equally adaptable, to incorporate the bottom finish technique of the present invention.

Figure 3:
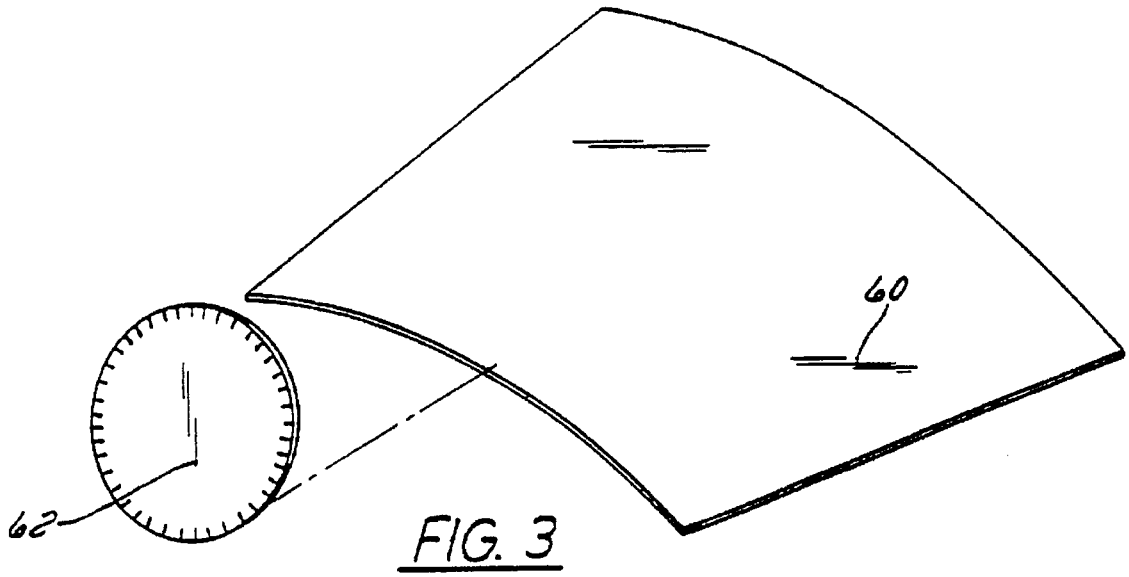
FIG. 3 is a schematic representation of the bottom blank and the sidewall blank which are combined to form a cup like the one shown in FIG. 2.
Figure 2:
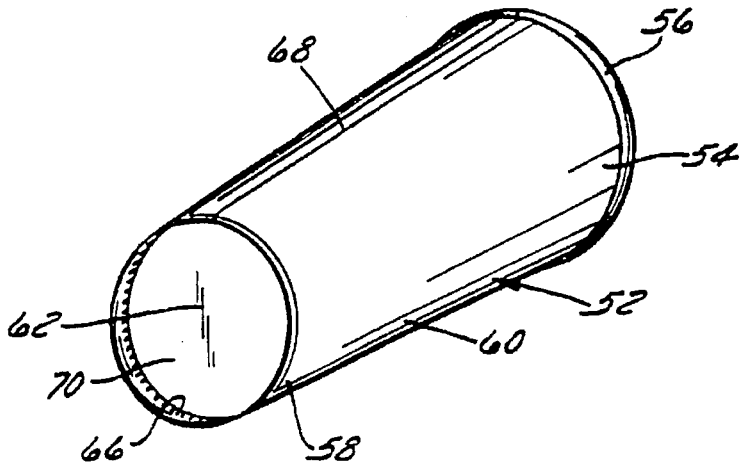
FIG. 2 is a bottom perspective view of one type of cup which may be made on a cup making machine.
Figure 4:
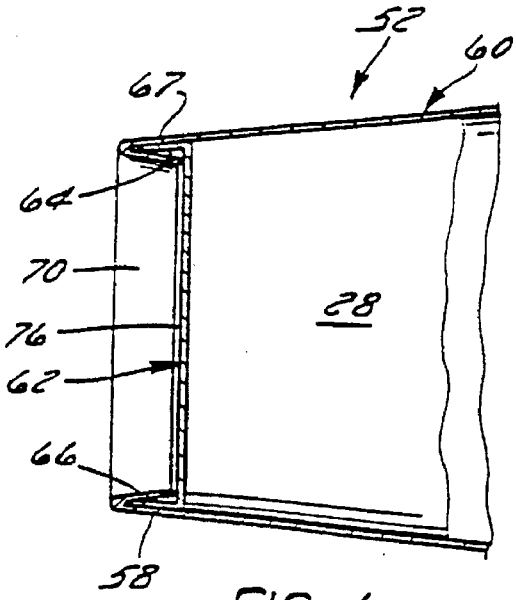
FIG. 4 is a cross-sectional view showing the area at which the sidewall blank is joined to the bottom blank forming the cup shown in FIG. 2.

Bottom blank maker workstation 30 can be sized and designed to make a variety of cups or other containers, and one example is illustrated in FIGS. 2–4. An exemplary cup 52 includes an upper region 54 having a curled rim 56 and a bottom region 58. Cup 52 is made from a sidewall blank 60 which is wrapped around a bottom blank 62 disposed generally transverse thereto. Bottom blank 62 is typically bent or folded over in proximity to its outer edge to form a lip 64. The sidewall blank 60 is located with respect to bottom blank 62 so that a flap portion 66 extends beyond lip 64. Flap portion 66 is bent or folded around lip 64 so lip 64 may be squeezed between flap portion 66 and a lower region 67 of sidewall blank 60 (see FIG. 4).

A typical cup 52 is made from paperboard blanks having a thermoplastic coating, such as polypropylene. The thermoplastic material permits heating and sealing of adjacent components. For instance, when sidewall blank 60 is wrapped around bottom blank 62, the adjacent edges are heated and pressed together to form a seal 68. Similarly, lip 64, flap portion 66, and lower region 67 of sidewall blank 60 may be heated and pressed together at bottom finish station 40 to form a strong, leak-proof bottom region 58. By forming cup 52 as illustrated in FIG. 4, a recessed area 70 is created in the bottom of cup 52 on an opposite side of bottom blank 62 from the main container body of cup 52. Recessed area 70 permits insertion of a tool to press lip 64 and flap portion 66 towards the lower region 67 of sidewall blank 60.

Figure 5:
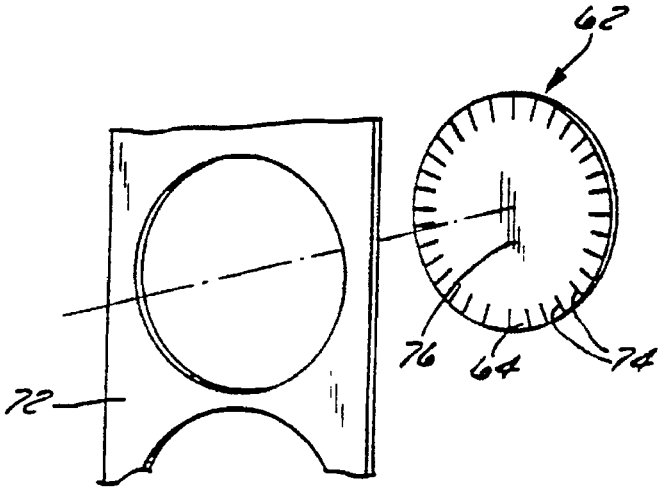
FIG. 5 is an exploded perspective view of the bottom blank web and a bottom blank cut from the web.
Figure 6:
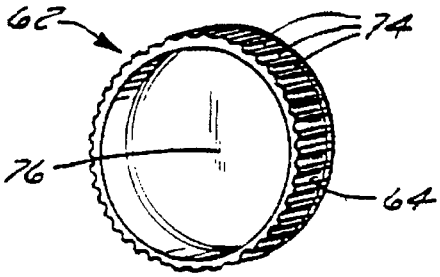
FIG. 6 is a perspective view of the bottom blank having its outer lip folded and showing the formed indentations.

As illustrated in FIG. 5, bottom blank 62 is preferably cut from a web of material 72, such as paperboard. Bottom blank 62 may be cut in any of a variety of configurations depending on the shape of the container, but typically bottom blank 62 is cut into a circular or disk-like shape. Bottom blank 62 includes a series of indentations 74 disposed about lip 64. Preferably, indentations 74 are impressed in bottom blank 62 to form generally linear radially extending indentations. After impressing indentations 74 on bottom blank 62, lip 64 is folded or bent over until it extends generally transversely to a central region 76 of bottom blank 62 (see FIG. 6).

Referring now generally to FIGS. 7–11, bottom blank maker workstation 30 is shown to include a framework 78 on which is mounted a reciprocable punch 80 and a reciprocable draw 82. Punch 80 and draw 82 interact with a sleeve member 84 having an abutment surface 86 and an inner cylindrical surface 88. Abutment surface 86 is disposed to cooperate with punch 80 and is generally transverse to cylindrical surface 88 which is oriented to allow movement of reciprocable draw 82 therethrough.

Figure 12:
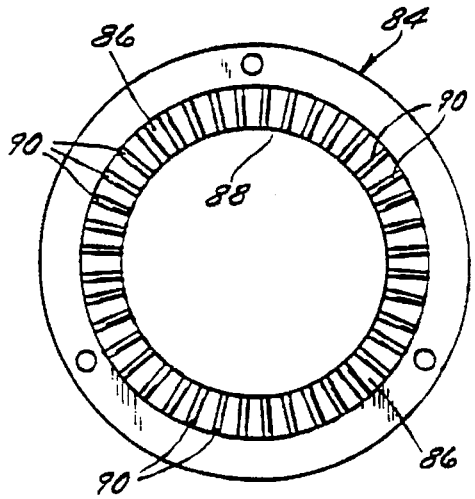
FIG. 12 is a back view of the abutment surface to which the protrusions are attached.
Figure 13:
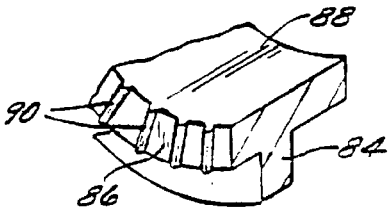
FIG. 13 is a partial cross-sectional perspective view showing the abutment surface and extended ribs.

A plurality of protrusions 90, such as radially extending ribs, are disposed between punch 80 and abutment surface 86 to impress lip 64 of bottom blank 62 with indentations when punch 80 moves into proximity with abutment surface 86. Preferably, protrusions 90 extend from abutment surface 86 (see FIGS. 12 and 13). Additionally, a reciprocation assembly 92 is connected to punch 80 and draw 82 to selectively slide them into and out of cooperation with sleeve member 84 and the mandrel 28 adjacent bottom maker workstation 30.

In the preferred embodiment, reciprocable punch 80 includes a tail section 94 slidably mounted in framework 78 on at least one and preferably a pair of slides 95. Tail section 94 is connected to a punch head 96 that is reciprocated into and out of cooperation with abutment surface 86 and protrusions 90 to impress the lip 64 of bottom blank 62 with indentations 74. In the typical arrangement, punch head 96 is generally annular in shape having a punch surface 98 appropriately sized to contact lip 64 of bottom blank 62. Additionally, the inside of the annular punch head 96 is defined by a cylindrical surface 100 along which reciprocable draw 82 may move. Preferably, tail section 94 also includes an open or hollow interior 102 to permit draw 82 to reciprocate generally through the center of punch 80.

As illustrated, draw 82 preferably also includes a head 104 which may be referred to as a draw head and which is configured to move along inner cylindrical surface 100 of punch head 96 and inner cylindrical surface 88 of sleeve member 84. Draw head 104 is connected to a draw rod 106 that is slidably mounted within hollow interior 102 of punch 80, preferably on a pair of slides 108.

Reciprocation assembly 92 is connected to punch 80 and draw 82 to move the punch into cooperation with the abutment surface 86 and the plurality of protrusions 90. Assembly 92 also moves draw 82 through sleeve member 84 and into cooperation with the mandrel 28 adjacent bottom blank maker workstation 30.

Although a variety of reciprocation assemblies could be used, the preferred embodiment includes a draw subassembly 110 and a punch subassembly 112. Preferably, the entire reciprocation assembly 92 is powered by an input shaft 114 rotatably mounted in framework 78 by bearings 116. Input shaft 114 may be driven by any conventional mechanisms known to those of ordinary skill in the art, such as cams, gears or belt and pulley arrangements which, in turn, are powered by a power source, such as an electric motor (not shown).

Figure 7:
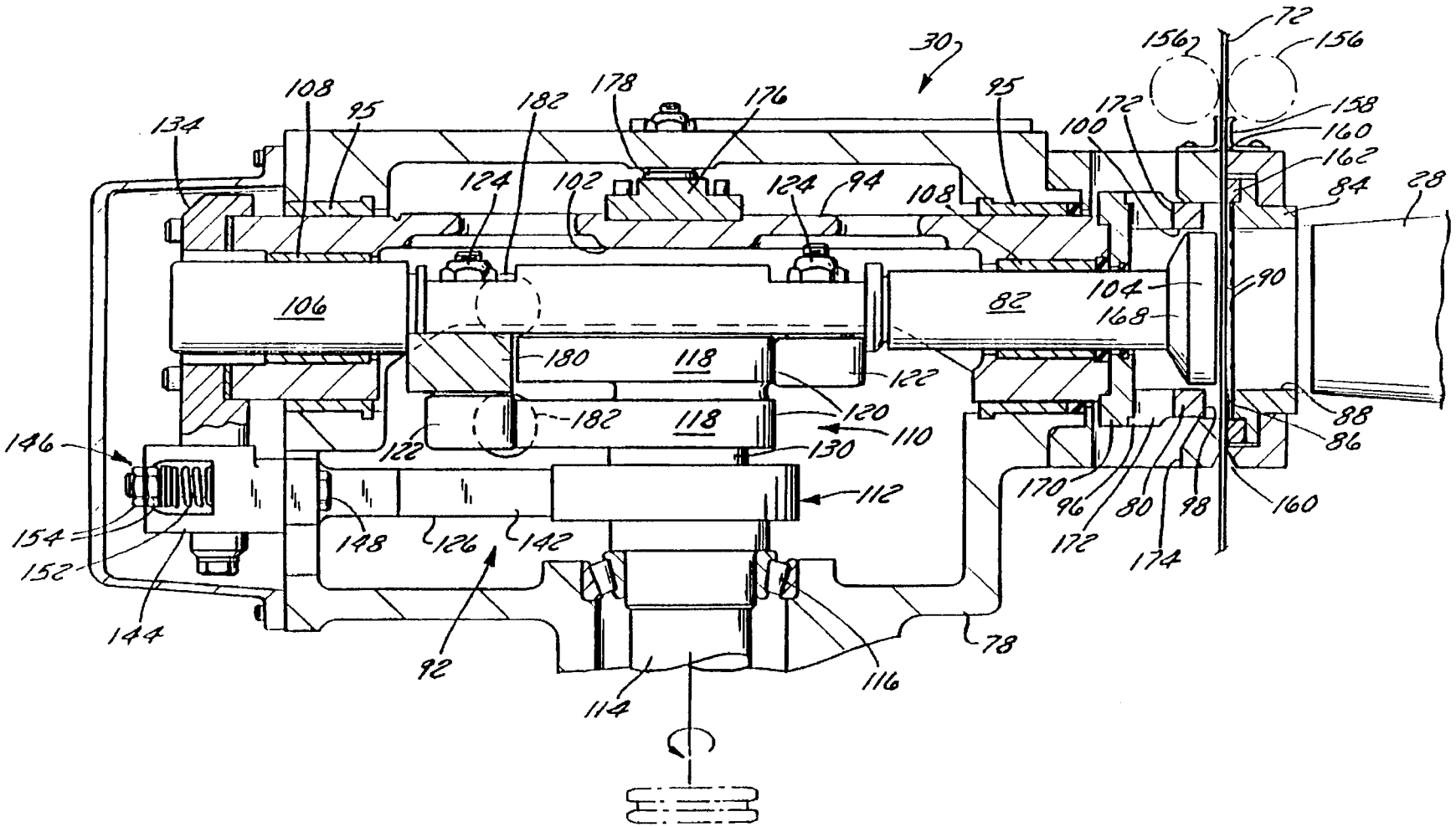
FIG. 7 is a cross-sectional view of a bottom maker workstation in accordance with the present invention, showing the punch and draw slidably mounted therein.
Figure 8:
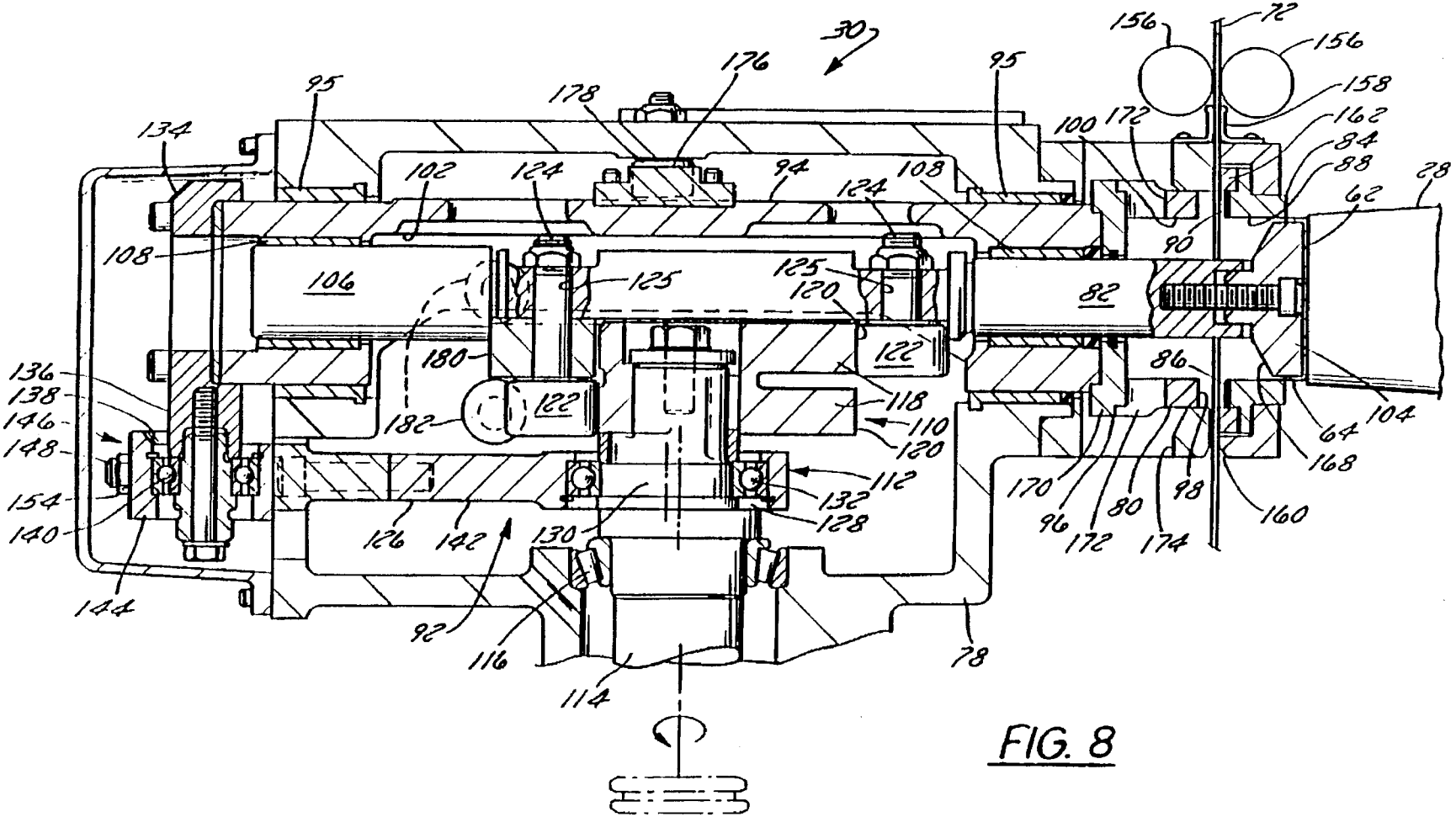
FIG. 8 is a cross-sectional view of the bottom blank maker workstation similar to that shown in FIG. 7 but showing the draw moving the bottom blank through the sleeve.

Draw subassembly 110 preferably includes a pair of cams 118 mounted to input shaft 114. Each cam 118 includes a cam surface 120 that acts against a corresponding cam follower 122. Cam followers 122 are attached to a mid-section of draw rod 106 by a fastener 124, such as a bolt and nut, wherein the bolt extends through a bore 125 formed through draw rod 106, as illustrated in FIGS. 7 and 8. The cam followers 122 are preferably disposed on opposite sides of the pair of cams 118 and each cam surface 120 has generally the same profile so draw 82 is reciprocated towards and away from the adjacent mandrel 28 as input shaft 114 is rotated.

Figure 14:
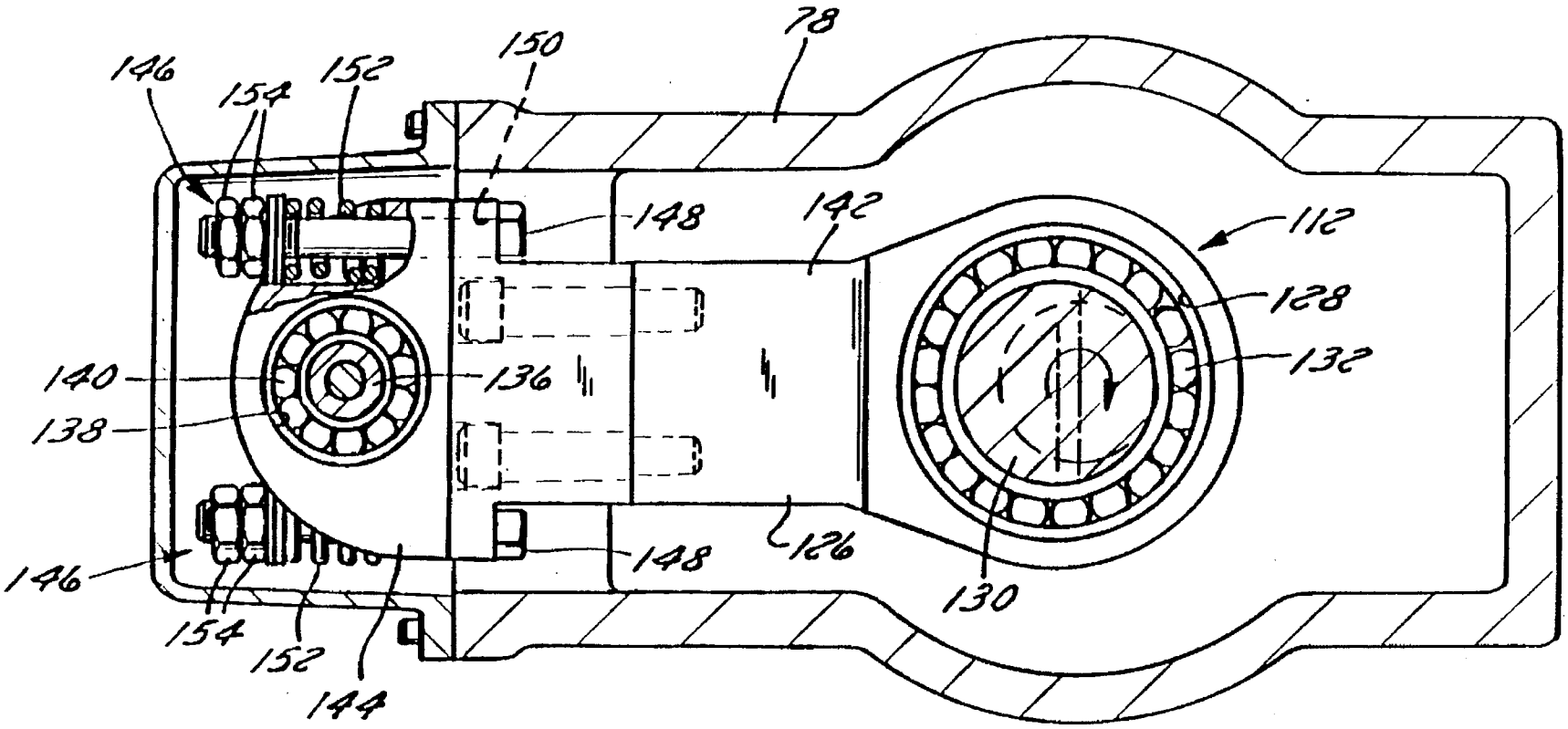
FIG. 14 is a side view of the mechanism for reciprocating the punch.

Punch subassembly 112 includes an arm 126 having a circular opening 128 mounted over input shaft 114. An eccentric 130 is attached to input shaft 114 and rotates within circular opening 128, preferably within a bearing such as ball bearing 132 (see FIG. 14). Thus, as input shaft 114 rotates, eccentric 130 forces arm 126 to reciprocate. Arm 126 is also attached to a back plate 134 of punch 80 to further reciprocate punch 80 as input shaft 114 rotates. In the preferred embodiment, back plate 134 includes a rod 136 that extends into a back opening 138 disposed through arm 126 at a spaced distance from circular opening 128. Rod 136 may be connected through back opening 138 by a bearing, such as ball bearing 140.

To prevent breakage in the event punch 80 strikes a solid object, arm 126 is preferably divided into a front portion 142 and a back portion 144. Front portion 142 and back portion 144 are held together by a spring loaded fastener 146. In the illustrated embodiment, fastener 146 includes a pair of bolts 148 extending through a bore 150 disposed in front portion 142 and back portion 144. Bolts 148 are generally aligned with the direction of reciprocable motion of arm 126 and include springs 152 held in place on bolts 148 by nuts 154. Nuts 154 may be tightened or loosened to adjust the tension in springs 152. Thus, if punch 80 strikes a solid object, the biasing force of springs 152 will be overcome and back portion 144 will separate from front portion 142 to prevent damage to the workstation.

In operation, a paperboard web 72 is fed into bottom blank maker station 30 between a pair of rollers 156. Web 72 preferably enters a front portion of framework 78 through a guide member 158 and a slot 160 disposed through framework 78. The orientation of slot 160 directs web 72 to a cutting position in which sleeve member 84 is disposed on the mandrel side of web 72, while punch head 96 and draw head 104 are disposed on the opposite side of web 72 from sleeve member 84. Web 72 preferably rests against a cutter, such as cutter ring 162, at a slight distance from abutment surface 86 and protrusions 90.

Figure 9:
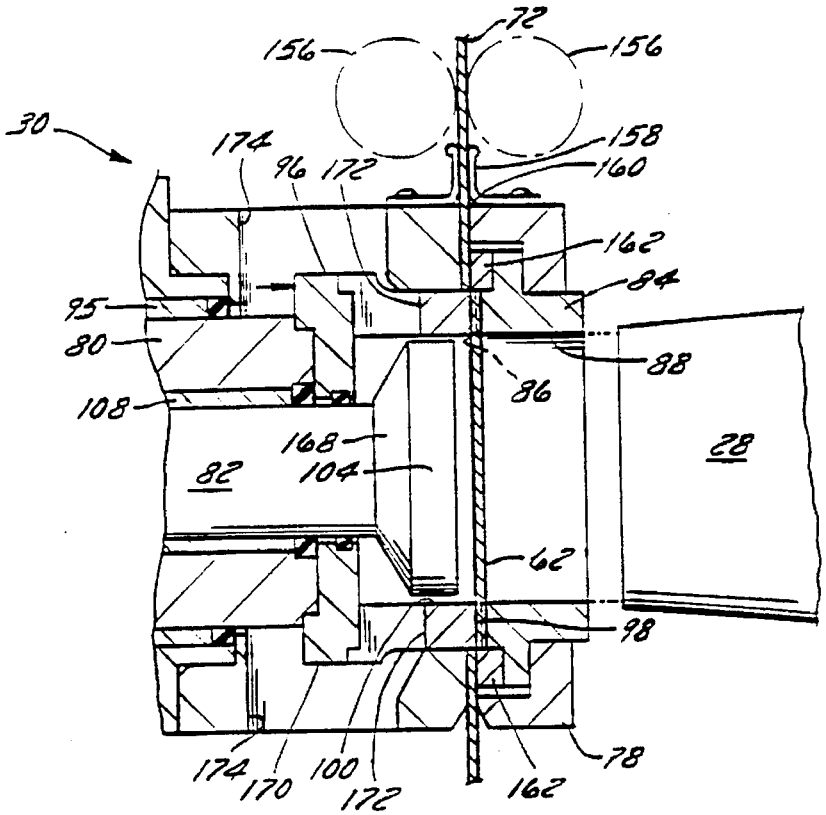
FIG. 9 is a partial cross-sectional view showing the punch cutting the bottom blank and forcing it against the protrusions.

Thus, when punch 80 is moved towards sleeve member 84 by reciprocation assembly 92, punch surface 98 forces web 72 against cutter ring 162 and cuts free the bottom blank 62 (see FIG. 9). Reciprocation assembly 92 continues to move punch 80 forward until the bottom blank is forced against protrusions 90 which impress a desired pattern, preferably radially extending and generally linear indentations, into lip 64 of bottom blank 62.

Figure 10:
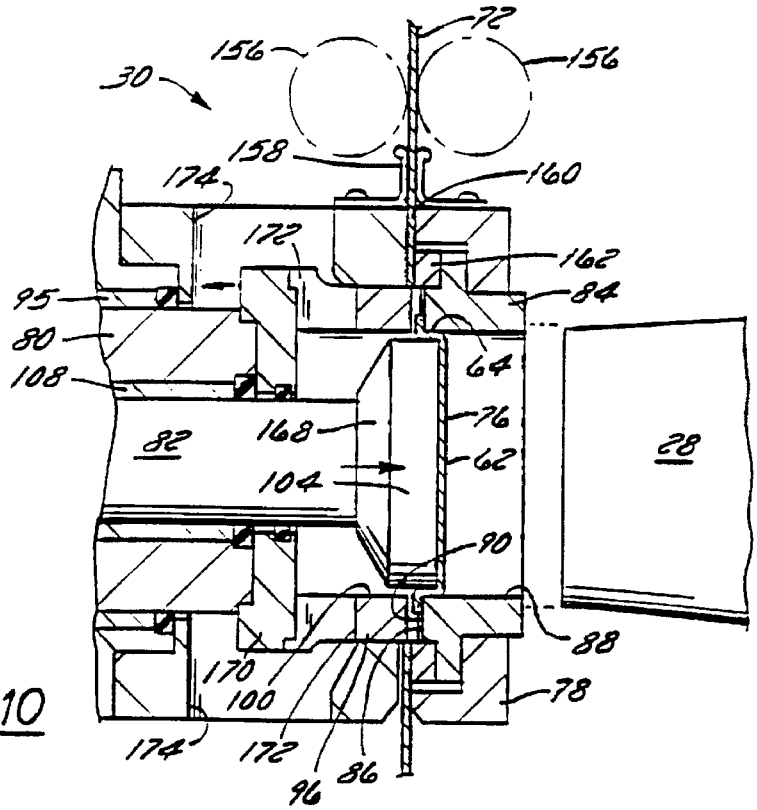
FIG. 10 is a partial cross-sectional view similar to FIG. 9 and showing the draw forcing the bottom blank through the sleeve.
Figure 11:
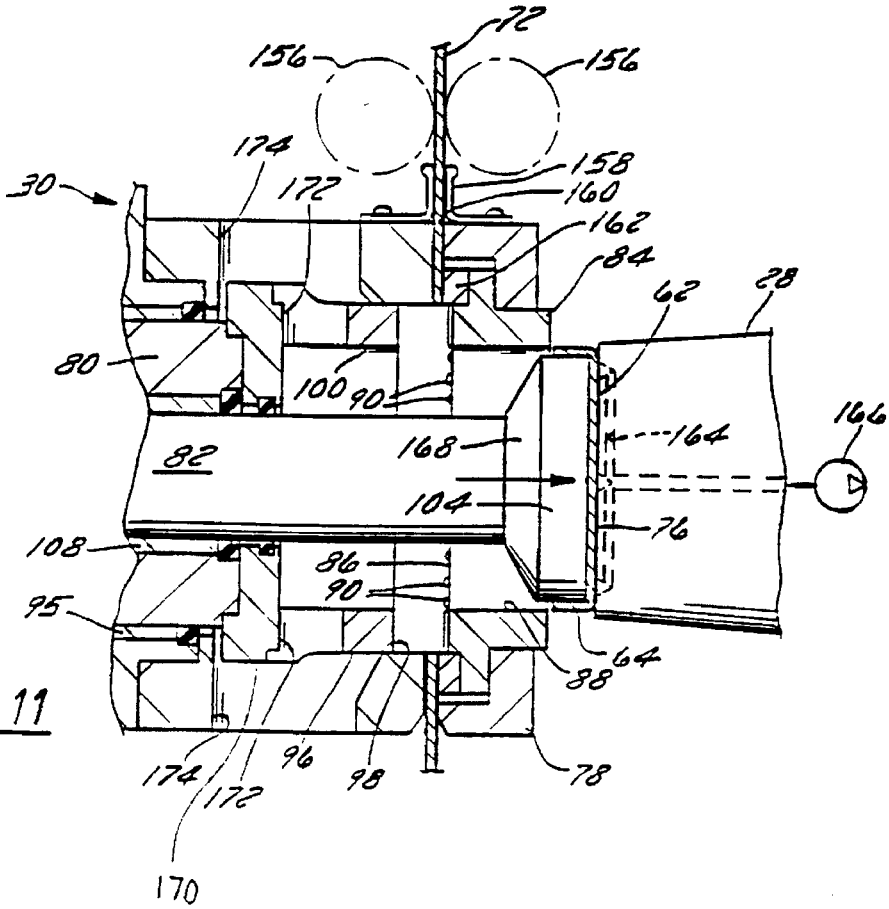
FIG. 11 is a partial cross-sectional view similar to FIG. 9 and showing the bottom blank pressed against the mandrel.

At this point, reciprocation assembly 92 and specifically cams 118 move draw head 104 against central region 76 of bottom blank 62 to force the bottom blank through the inner cylindrical surface 88 of sleeve member 84 (see FIG. 10). This movement of bottom blank 62 folds or bends lip 64 to an orientation generally transverse to central region 76 of the bottom blank. Then, as the punch is moved away from abutment surface 86, draw 82 continues to force bottom blank 62 through sleeve member 84 and into cooperation with the mandrel 28 adjacent bottom blank maker workstation 30 (see FIG. 11).

Preferably, each mandrel 28 is provided with a vacuum conduit 164 extending therethrough and connected to a vacuum source 166. The vacuum in vacuum conduit 164 holds bottom blank 62 to the end of mandrel 28 while sidewall blank 60 is wrapped around mandrel 28 and flap 66 is folded over lip 64 to form the bottom of the container. The regular indentations 74, preferably spaced uniformly, prevent bunching of lip 64 when it is bent and thus promotes a uniform and secure seal between the sidewall blank 60 and bottom blank 62 along the bottom of the cup. The regular indentations 74 provide controlled creases in lip 64, that can readily be sealed, and also prevent large irregular crevices that normally result from the bending of lip 64 and which lead to leakage.

Often, a light lubricant is placed on many of the moving components during the cutting operation. This can lead to addition problems, because during cutting of the bottom blanks from web 72 a substantial amount of debris, such as paperboard dust, is created. The dust combines with the lubricant to form a thick, pasty debris that can be detrimental to the smooth reciprocation of punch 80 and draw 82. This is a particular problem in the spaces between draw head 104 and punch head 96. Therefore, draw head 104 has been designed with a sloping back surface 168 which cooperates with a back wall 170 of punch head 96 when draw 82 is moved away from sleeve member 84. As the sloping back surface 168 is moved closer to back wall 170, any accumulation of debris is squeezed outwardly towards the inner cylindrical surface 100 of punch head 96 and through at least one hole 172, and preferably a plurality of holes, to the outside of punch head 96. Thus, debris is continually moved away from the reciprocating components to an area that will not affect their actuation. Additionally, framework 78 may include openings 174 to permit the debris to drop completely away from bottom blank maker workstation 30.

Figure 15:
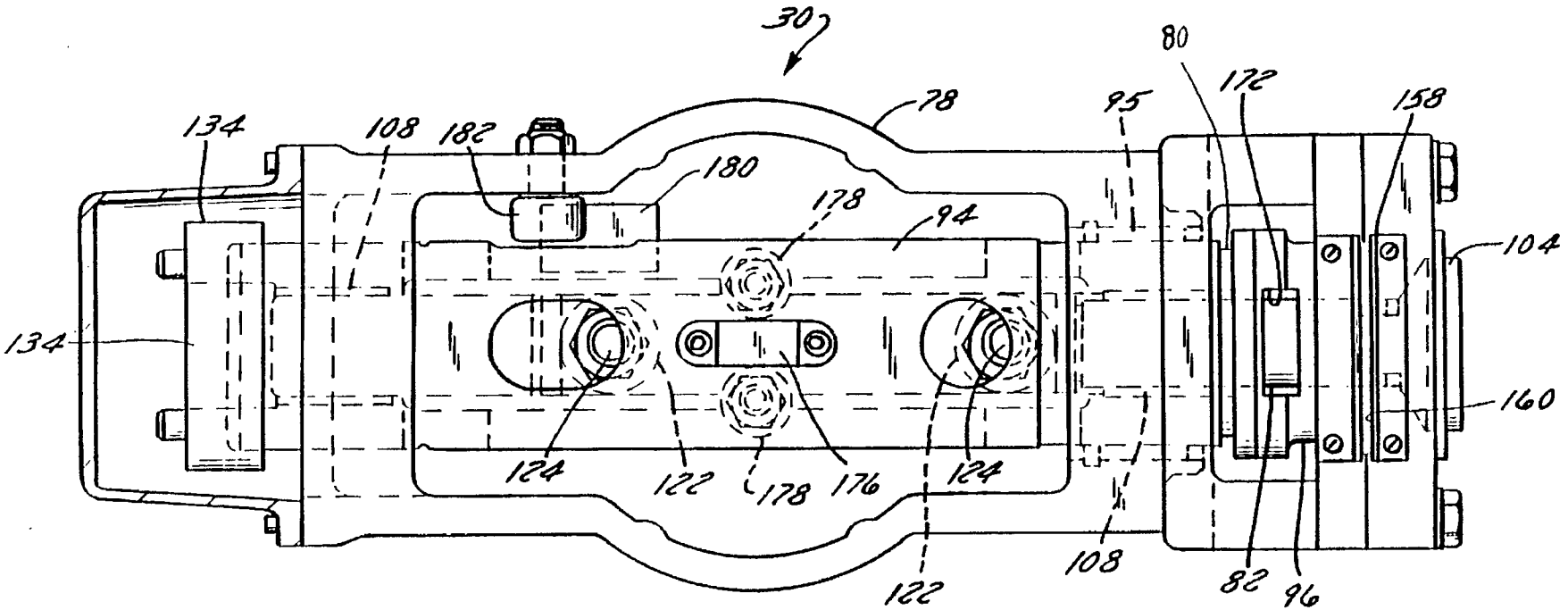
FIG. 15 is a top view of the bottom blank maker workstation.

As shown most clearly in FIG. 15, a guide 176 may be rigidly attached to punch 80 and disposed for movement between a pair of rollers 178 fastened to framework 78. Guide 176 moves longitudinally between rollers 178, but the rollers prevent any rotational movement of punch 80 to promote overall rigidity of the workstation. Similarly, a guide 180 is rigidly attached to draw 82. Guide 180 is disposed for movement between a pair of rollers 182 attached to framework 78. This arrangement similarly allows longitudinal movement of draw 82 but prevents any rotational movement thereof.

It will be understood that the foregoing description is of a preferred exemplary embodiment of this invention and that the invention is not limited to the specific forms shown. For example, the workstation may be designed to cut and form bottom blanks having different configurations than the disk configuration illustrated in the Figures, the reciprocation assembly can use a different arrangement of cams, rods, or eccentrics to provide the necessary reciprocable motion of the draw and punch, the protrusions can take a variety of configurations other than radially extending linear ribs, and the protrusions can potentially be disposed on either side of the web prior to impressing the indentations. These and other modifications may be made in the design and arrangement of the elements without departing from the scope of the invention as expressed in the appended claims.

What is claimed is:

1. A bottom blank maker workstation useful in combination with a cup making machine having a rotating turret and a plurality of mandrels arranged to interact with a plurality of workstations, the turret moving each mandrel in a stepwise fashion sequentially through the plurality of workstations, each mandrel being configured to receive a bottom blank at the bottom blank maker workstation, the bottom blank maker workstation comprising:

a framework;

a reciprocable punch slidably mounted to the framework and configured to contact an outer region of the bottom blank;

an abutment surface;

a plurality of ribs disposed between the reciprocable punch and the abutment surface;

a reciprocable draw slidably mounted to the framework for movement through a sleeve; and a reciprocation assembly, wherein the reciprocation assembly first moves the punch towards the abutment surface until the plurality of ribs impresses the bottom blank and then moves the draw past the abutment surface to force the bottom blank through the sleeve and into cooperation with an adjacent mandrel;

wherein the reciprocable punch includes a cylindrical side wall having a front surface configured for contacting the bottom blank, a back wall, and at least one opening extending through the cylindrical side wall in proximity to the back wall;

the reciprocable draw including a front surface configured for contacting the bottom blank and a back surface having a taper that cooperates with the opening when the draw moves away from the mandrel to squeeze debris through at least one opening and to the outside of the reciprocable punch.

2. The bottom blank maker workstation as recited in claim 1, wherein the reciprocable punch is comprised of an annular ring.

3. The bottom blank maker workstation as recited in claim 2, wherein the draw includes a cylindrical portion which reciprocates within the annular ring and the sleeve.

4. The bottom blank maker workstation as recited in claim 3, further comprising an annular shearing edge disposed to cut the bottom blank as the reciprocable punch moves towards the abutment surface.

5. The bottom blank maker workstation as recited in claim 3, wherein the ribs are disposed to provide radially extending impressions throughout the outer region of the bottom blank.

6. The bottom blank maker workstation as recited in claim 5, wherein the ribs extend from the abutment surface.

7. The bottom blank maker workstation as recited in claim 1, wherein the reciprocation assembly includes an input shaft connected to a cam that cooperates with a cam follower, the cam follower being connected to the reciprocable draw.

8. The bottom blank maker workstation as recited in claim 7, wherein the reciprocation assembly includes:

an arm attached to the reciprocable punch, the arm having a circular opening; and an eccentric connected to the input shaft and rotatably received in the circular opening to reciprocate the arm.

9. A bottom blank maker workstation for a cup making machine having a rotating turret and a plurality of mandrels arranged to interact with a plurality of workstations, the turret moving each mandrel in a stepwise fashion sequentially through the plurality of workstations, each mandrel being configured to receive a bottom blank at the bottom blank maker workstation, the bottom blank maker workstation comprising:

a framework;

a punch having an inner cylindrical surface and an annular punch surface configured to contact the bottom blank at an outer annular region thereof, the punch being slidably mounted to the framework to move the bottom blank;

a draw configured for movement through the punch along the inner cylindrical surface, the draw being disposed to move the bottom blank;

a sleeve member having an inner cylindrical sleeve surface through which the draw presses the bottom blank into cooperation with an adjacent mandrel, the sleeve member further including an impression surface generally transverse to the inner cylindrical sleeve surface and disposed to impress the bottom blank as it is moved towards the adjacent mandrel; and an assembly configured to reciprocate the punch with respect to the impression surface and to reciprocate the draw through the sleeve;

wherein the reciprocable punch includes a cylindrical side wall having a front surface configured for contacting the bottom blank, a back wall, and at least one opening extending through the cylindrical side wall in proximity to the back wall;

the reciprocable draw including a front surface configured for contacting the bottom blank and a back surface having a taper that cooperates with the opening when the draw moves away from the mandrel to squeeze debris through at least one opening and to the outside of the reciprocable punch.

10. The bottom blank workstation as recited in claim 9, wherein the impression surface includes a plurality of extending ribs.

11. The bottom blank workstation as recited in claim 10, wherein the impression surface is an annular surface and the ribs are disposed to extend radially on the annular surface.

12. The bottom blank workstation as recited in claim 9, wherein the assembly includes input shaft connected to a cam that cooperates with a cam follower, the cam follower being connected to the reciprocable draw.

13. The bottom blank workstation as recited in claim 12, wherein the assembly includes:

an arm attached to the reciprocable punch, the arm having a circular opening; and an eccentric connected to the input shaft and rotatably received in the circular opening to reciprocate the arm.

14. A bottom blank maker workstation, comprising:

a framework;

a reciprocal punch slidably mounted to the framework, wherein the reciprocal punch includes a cylindrical sidewall having a front surface configured for contacting a bottom blank, a back wall, and at least one opening extending through the cylindrical sidewall in proximity to the back wall; and a reciprocal draw slidably mounted to the framework, the reciprocal draw including a front surface configured for contacting the bottom blank and a back surface having a taper that cooperates with the opening to squeeze debris through at least one opening and to the outside of the reciprocal punch.

* * * * *